US005929014A

United States Patent [19]

Beaujean et al.

[11] Patent Number: 5,929,014

[45] Date of Patent: Jul. 27, 1999

[54] PASTE-FORM DETERGENT

[75] Inventors: Hans-Josef Beaujean, Dormagen; Thomas Merz, Hilden; Erich Holz, Dusseldorf; Thomas Holderbaum, Monheim; Guenther Amberg, Neuss; Khalil Shamayeli, Duesseldorf; Michael Marschner, Neuss; Hubert Harth, Hilden, all of Germany

[73] Assignee: Henkel-Ecolab GmbH & Co. OHG, Duesseldorf, Germany

[21] Appl. No.: 08/619,738

[22] PCT Filed: Sep. 19, 1994

[86] PCT No.: PCT/EP94/03122

§ 371 Date: Apr. 18, 1996

§ 102(e) Date: Apr. 18, 1996

[87] PCT Pub. No.: WO95/09229

PCT Pub. Date: Apr. 6, 1995

[30] Foreign Application Priority Data

Sep. 27, 1993 [DE] Germany ..... 43 32 849

[51] Int. Cl.[6] ..... C11D 17/08

[52] U.S. Cl. ..... 510/336; 510/403; 510/404; 510/421; 510/422; 510/424; 510/425; 510/430

[58] Field of Search ..... 510/404, 403, 510/421, 336, 422, 430, 424, 425

[56] References Cited

U.S. PATENT DOCUMENTS

| | | | |
|---|---|---|---|
| 3,931,033 | 1/1976 | Lohr et al. | 252/122 |
| 4,144,226 | 3/1979 | Crutchfield et al. | 528/231 |
| 4,146,495 | 3/1979 | Crutfield et al. | 252/89 R |
| 4,608,189 | 8/1986 | Koch et al. | 252/174.22 |
| 4,820,439 | 4/1989 | Rieck | 252/135 |
| 4,889,644 | 12/1989 | Amberg et al. | 252/8.9 |
| 4,925,585 | 5/1990 | Strauss et al. | 252/89.1 |
| 4,929,380 | 5/1990 | Scgulz et al. | 252/121 |
| 5,234,628 | 8/1993 | Trabitzch et al. | 252/540 |
| 5,364,552 | 11/1994 | Merz et al. | 252/174.22 |
| 5,417,951 | 5/1995 | Just | 423/334 |
| 5,447,651 | 9/1995 | Karpusiewicz et al. | 252/174 |
| 5,453,215 | 9/1995 | Karpusiewicz et al. | 252/174 |

FOREIGN PATENT DOCUMENTS

| | | |
|---|---|---|
| 2254635 | 7/1975 | European Pat. Off. . |
| 0022551 | 1/1981 | European Pat. Off. . |
| 0104434 | 4/1984 | European Pat. Off. . |
| 0164514 | 12/1985 | European Pat. Off. . |
| 0253151 | 1/1988 | European Pat. Off. . |
| 0295525 | 12/1988 | European Pat. Off. . |
| P4332820 | 3/1930 | Germany . |
| 2412837 | 10/1974 | Germany . |
| 3719906 | 12/1988 | Germany . |
| 4221381 | 2/1994 | Germany . |
| 4300772 | 7/1994 | Germany . |
| P4332850 | 3/1995 | Germany . |
| 63-150397 | 5/1989 | Japan . |
| 2204321 | 11/1988 | United Kingdom . |
| WO9108171 | 6/1991 | WIPO . |
| WO9205235 | 4/1992 | WIPO . |
| WO9308251 | 4/1993 | WIPO . |

*Primary Examiner*—Paul Lieberman
*Assistant Examiner*—Necholus Ogden
*Attorney, Agent, or Firm*—Ernest G. Szoke; Wayne C. Jaeschke; Daniel S. Ortiz

[57] ABSTRACT

A storable, substantially water-free flowable surfactant mixture containing 40% by weight to 70% by weight of a nonionic surfactant of the formula $R^1$—$(OC_2H_4)_n$—OH wherein $R^1$ is an alkyl or alkenyl group containing 10 to 20 carbon atoms and an average degree of ethoxylation n of from 1 to 8; 20% by weight to 50% by weight of a nonionic surfactant, liquid at room temperature, of the formula: $R^2$—$(OC_2H_4)_r$—$(OC_3H_6)_p$—OH wherein $R^2$ is an alkyl or alkenyl group containing 10 to 20 carbon atoms, an average degree of ethoxylation r of from 2 to 8 and an average degree of propoxylation p of from 1 to 6; and 1% by weight to 10% by weight of a $C_{10}$ to $C_{22}$ carboxylic acid and/or alkali metal salts thereof. The flowable surfactant mixture provides a base for forming a pseudo-plastic detergent formulation. The pseudoplastic detergent formulation is formed by introducing solid materials such as an anionic surfactants, solid foam regulators, detergent builders and the like. When the solid materials are introduced into the substantially water-free, flowable surfactant mixture, a paste-form detergent is formed. The paste-form detergent does not flow under the action of gravity but upon introducing shear energy into the mixture, the viscosity is reduced and the composition flows under the force of gravity. Upon removing the shearing forces, the composition returns to its pseudoplastic form.

20 Claims, No Drawings

PASTE-FORM DETERGENT

FIELD OF THE INVENTION

This invention relates to pseudoplastic paste-form detergents, more particularly for automatic dispensing in institutional washing machines, to a process for dispensing these pseudoplastic detergents, to a process for their production and to stable, free-flowing surfactant mixtures specially adapted to the production process which contain nonionic surfactant, a long-chain carboxylic acid or salt thereof and optionally synthetic anionic surfactant.

RELATED ART

Liquid to paste-form detergents have become known in large numbers, particularly over recent years. They are generally adapted to domestic requirements so that, normally, they have to be sufficiently fluid to be able to be poured out and dispensed without difficulty. Since, in addition, liquid detergents of the type in question have to be stable in storage over relatively wide temperature ranges without losing their liquid properties, it is often necessary to add organic solvents and/or hydrotropes which do not themselves make any contribution to the washing or cleaning result and are therefore undesirable. One method of avoiding possible dispensing problems with detergents showing inadequate flowability is proposed in European patent application EP 253 151 A2. This document describes liquid and, in some cases, highly viscous detergents based on nonionic and anionic surfactants which contain polyethylene glycol as hydrotrope and which are packed in portions in bags of a water-soluble material.

The paste-form detergent proposed in DE 37 19 906 A1 consists of a phase formed from nonionic surfactant which is liquid at temperatures below 10° C. and—dispersed therein—a solid phase with a certain particle size which is formed from washing alkalis, sequestering agents and optionally anionic surfactants. The surfactants or mixtures used have pour points (solidification points) below 5° C. to ensure that the paste does not solidify at low transport and storage temperatures. This detergent paste for institutional laundries has such good flow properties that it can be transported through a suction pipe by a conventional feed pump which is undoubtedly an advantage. However, it has now been found that, during their production, the pastes in question cannot always satisfactorily guarantee the homogeneity of their mixed ingredients and often tend to separate, even in storage. This negative property involves not only the separation of the solid constituents from the liquid constituents, but also the phase separation of the liquid constituents. This disadvantage is particularly noticeable when the pastes stored in storage containers are exposed to shear forces. Thus, although the viscosity of known pastes can be reduced by shearing, which makes them even easier to pump and dispense, phase separation of the already sheared, but as yet unpumped paste in the storage container generally cannot be avoided. Accordingly, there was a need even more effectively to prevent separation of the paste ingredients both during production and during shearing under removal conditions from the transport or storage container and further to increase the stability of the detergent paste in storage.

BRIEF DESCRIPTION OF THE INVENTION

Surprisingly, this has largely been achieved by modifying the viscosity and pseudoplasticity of the paste. The paste-form detergents according to the invention have such a high viscosity at room temperature (20° C. to 25° C.) in the absence of shear forces that they are unable to flow out from containers or to be transported simply under the effect of suction. Even the shearing effect of a displaceable plate or a plunger of the type provided in the metering or dispensing system according to DE-OS 37 19 906 A1 is by no means sufficient to reduce the viscosity of the paste-form detergents according to the invention to such an extent that they can be transported by a suction pump. Only relatively powerful shear forces of the magnitude generated, for example, by the paste container and dispenser according to hitherto unpublished German patent application P 43 32 850.4 in the name of Henkel Ecolab GmbH & Co. OHG are capable of producing such a reduction, the detergents according to the invention having the major advantage that they do not separate on exposure to shear forces and, on completion of shearing, for example if, as is generally the case, the entire contents of the storage container are not to be dispensed all at once into the institutional washing machine, largely exhibit the same properties as they did before the beginning of shearing.

Corresponding pastes may advantageously be produced using a free-flowing, storable surfactant mixture of a certain nonionic surfactant and a long-chain carboxylic acid and/or soap which exhibits the pseudoplasticity mentioned above to a distinctly reduced extent, if at all.

Accordingly, the present invention relates to a storable, substantially water-free, flowable surfactant mixture containing nonionic surfactant in the form of alkoxylation products of alcohol and soap, which in the present case is understood to be a long-chain carboxylic acid and/or a salt thereof, characterized in that it contains 40% by weight to 70% by weight of nonionic surfactant—liquid at room temperature—corresponding to general formula (I):

$$R^1—(OC_2H_4)_n—OH \quad (I)$$

in which $R^1$ is an alkyl or alkenyl radical containing 9 to 20 carbon atoms and the average degree of ethoxylation n may assume a value of 1 to 8 and, more particularly, 1 to 6, 20% by weight to 50% by weight of nonionic surfactant—liquid at room temperature—corresponding to general formula (II):

$$R^2—(OC_2H_4)_r—(OC_3H_6)_p—OH \quad (II)$$

in which $R^2$ is an alkyl or alkenyl radical containing 9 to 20 carbon atoms, the average degree of ethoxylation r may assume a value of 2 to 8 and the average degree of propoxylation p may assume a value of 1 to 6, and 1% by weight to 10% by weight of a $C_{10-22}$ carboxylic acid and/or an alkali metal salt thereof.

The present invention also relates to a pseudoplastic paste-form detergent or cleaning composition which has been produced in particular using the above-mentioned surfactant mixture and which has such a viscosity in the absence of shear forces that it does not flow under the effect of gravity at room temperature, but has a distinctly lower viscosity and flows under the effect of gravity on shearing. This property can be experimentally verified by measuring the viscosity of the paste under various shearing conditions, for example using a standard rotational viscosimeter at various rotational speeds of the spindle. Where viscosity is measured with a Brookfield® DV-II or DV-II plus rotational viscosimeter with a No. 7 spindle, pastes according to the invention preferably have a viscosity at 25° C. of more than 100,000 mPa·s, more particularly in the range from 150,000 mPa·s to 500,000 mPa·s, at 5 revolutions per minute and below 100,000 mPa·s, more particularly in the range from 10,000 mPa·s to 90,000 mPa·s and more preferably in the range from 50,000 mPa·s to 80,000 mPa·s at 50 revolutions per minute. To take any thixotropic effects of the paste into account, the figures cited above are read off after a measuring time of 3 minutes and are merely intended as reference points because comparatively minor changes in the measuring conditions (temperature or viscosimeter), as indicated hereinafter, can lead to different viscosity measurement results.

The present invention also relates to a process for charging a washing machine, more particularly an institutional washing machine, with liquid and solid detergent components, characterized in that a flowable surfactant mixture, more particularly containing 40% by weight to 70% by weight of a nonionic surfactant liquid at room temperature corresponding to general formula (I) above, 20% by weight to 50% by weight of a nonionic surfactant liquid at room temperature corresponding to general formula (II) above and 1% by weight to 10% by weight of a $C_{10-22}$ carboxylic acid and/or an alkali metal salt thereof is produced, a fine-particle solid is dispersed therein, the storable, non-flowable preparation thus obtained is made flowable immediately before use by application of mechanical energy, more particularly in the form of stirring, the flowable preparation is diluted with a predetermined quantity of water and is introduced into the washing machine.

DETAILED DESCRIPTION OF THE INVENTION

In the compounds corresponding to formulae I and II above, the substituents $R^1$ and $R^2$ may be linear or branched, for example 2-methyl-branched (oxoalcohols). The nonionic surfactant corresponding to formula (I) preferably has an average degree of ethoxylation n of 2 to 4 and/or the nonionic surfactant corresponding to formula (II) has an average degree of ethoxylation r of 3 to 7 and/or an average degree of propoxylation p of 3 to 5. Examples of suitable nonionic surfactants are $C_{9-11}$ oxoalcohols containing 2 to 10 EO, such as $C_{9-11}$+3 EO, $C_{9-11}$+5 EO, $C_{9-11}$+7 EO, $C_{9-11}$+9 EO; $C_{11-13}$ oxoalcohols containing 2 to 8 EO, such as $C_{11-13}$+2 EO, $C_{11-13}$+5 EO, $C_{11-13}$+6 EO, $C_{11-13}$+7 EO; $C_{12-15}$ oxoalcohols containing 3 to 6 EO, such as $C_{12-15}$+3 EO, $C_{12-15}$+5 EO; isotridecanol containing 3 to 8 EO; partly unsaturated linear $C_{10-16}$ fatty alcohols containing 8 EO; linear fatty alcohols containing 10 to 14 carbon atoms and 2.5 to 5 EO; linear saturated and unsaturated $C_{12-18}$ fatty alcohols or $C_{9-15}$ oxoalcohols containing 1 to 3 PO and 4 to 8 EO, such as $C_{12-18}$ cocoalcohol+$(EO)_{4-7}$ $(PO)_{1-2}$, oleyl alcohol or a 1:1 mixture of cetyl and oleyl alcohol+$(EO)_{5-7}$ $(PO)_{1-2}$, $C_{11-15}$ oxoalcohol+$(EO)_{4-6}$ $(PO)_{1-2}$.

Among the surfactants liquid at room temperature corresponding to formulae (I) and (II), those which melt at temperatures below 10° C. are particularly preferred. If desired, small quantities of nonionic surfactants with the same composition may be present providing it is ensured that the nonionic component of the surfactant mixture is liquid at room temperature and preferably at 10° C.

The surfactant mixture according to the invention preferably contains 48% by weight to 64% by weight of nonionic surfactant corresponding to general formula (I), 18% by weight to 40% by weight of nonionic surfactant corresponding to general formula (II) and 2% by weight to 6% by weight of carboxylic acid and/or alkali metal salt thereof.

In addition, a surfactant compound of the type in question may contain up to 10% by weight and, more particularly, from 0.5% by weight to 8% by weight of synthetic anionic surfactant solid at room temperature and/or up to 5% by weight and, more particularly, from 0.1% by weight to 4% by weight of alkali-stable and shear-stable foam regulator solid at room temperature.

Suitable synthetic anionic surfactants, which may be incorporated in the surfactant mixture according to the invention in solid, fine-particle, substantially water-free form, include in particular those of the sulfonate or sulfate type which are normally present as alkali metal salts, preferably sodium salts. However, the above-mentioned sulfonate surfactants in particular may also be used in the form of their free acids. Suitable anionic surfactants of the sulfonate type are alkyl benzene sulfonates with linear $C_{9-13}$ alkyl chains, more particularly dodecyl benzene sulfonate, linear alkane sulfonates containing 11 to 15 carbon atoms, which are obtainable by sulfochlorination or sulfoxidation of alkanes and subsequent saponification or neutralization, salts of sulfofatty acids and esters thereof derived from saturated $C_{12-18}$ fatty acids sulfonated in particular in the α-position and lower alcohols, such as methanol, ethanol and propanol, and olefin sulfonates of the type formed, for example, by the sulfonation of terminal $C_{12-18}$ olefins with $SO_3$ and subsequent alkaline hydrolysis. Suitable surfactants of the sulfate type are, in particular, the primary alkyl sulfates with preferably linear alkyl chains of 10 to 20 carbon atoms which have an alkali-, ammonium- or alkyl- or hydroxyalkyl-substituted ammonium ion as countercation. Derivatives of linear alcohols containing in particular 12 to 18 carbon atoms and branched-chain analogs thereof, so-called oxoalcohols, are particularly suitable. Accordingly, the sulfation products of primary fatty alcohols with linear dodecyl, tetradecyl, hexadecyl or octadecyl radicals and mixtures thereof are particularly useful. Particularly preferred alkyl sulfates contain a tallow alkyl radical, i.e. mixtures essentially containing hexadecyl and octadecyl radicals. The alkyl sulfates may be prepared in known manner by reaction of the corresponding alcohol component with a typical sulfating agent, more particularly sulfur trioxide or chlorosulfonic acid, and subsequent neutralization with alkali-, ammonium- or alkyl- or hydroxyalkyl-substituted ammonium bases. In addition, the sulfated alkoxylation products of the alcohols mentioned, so-called ether sulfates, may be present in the detergents. These ether sulfates preferably contain 2 to 30 and, more preferably, 4 to 10 ethylene glycol groups per molecule.

Preferred synthetic anionic surfactants are alkyl benzene sulfonates and/or alkyl sulfates.

Among the carboxylic acids or carboxylic acid salts present in the surfactant mixtures according to the invention, saturated and/or unsaturated $C_{12-22}$ fatty acids, for example coconut oil, palm kernel oil or tallow fatty acid, or alkali metal salts thereof (soaps) are preferred, although their branched-chain isomers may also be used. It is particularly preferred to use a carboxylic acid mixture of—based on the carboxylic acid mixture as a whole—2% by weight to 8% by weight of $C_{14}$, up to 1% by weight of $C_{15}$, 18% by weight to 24% by weight of $C_{16}$, up to 3% by weight of $C_{17}$, 20% by weight to 42% by weight of $C_{18}$ and 30% by weight to 44% by weight of $C_{20}$ to $C_{22}$ carboxylic acid or alkali metal salts thereof.

The alkali-stable and shear-stable foam regulator solid at room temperature may be selected, for example, from polysiloxane/silica mixtures, the fine-particle silica present therein preferably being silanized. The polysiloxanes may consist both of linear compounds and of crosslinked polysiloxane resins and mixtures thereof. Other defoamers are paraffin hydrocarbons, more particularly microparaffins and paraffin waxes, with melting points above 40° C., saturated fatty acids or soaps containing in particular 20 to 22 carbon atoms, for example sodium behenate, and alkali metal salts of phosphoric acid monoalkyl and/or dialkyl esters in which the alkyl chains contain 12 to 22 carbon atoms. Sodium monoalkyl phosphate and/or dialkyl phosphate containing $C_{16-18}$ alkyl groups is particularly preferred. The percentage content of foam regulators is preferably from 0.2% by weight to 2% by weight, based on the surfactant mixture according to the invention. In many cases, the tendency towards foaming can be reduced by a suitable choice of the nonionic surfactants so that there may be no need whatever to use defoaming foam regulators.

In the production of the surfactant mixtures according to the invention, it is important that the constituents solid at room temperature, including the carboxylic acid or its salt and—optionally—the synthetic anionic surfactant and the foam regulator, should be uniformly mixed with the nonionic surfactants. To this end, at least one of the nonionic surfactants corresponding to formula (I) or (II) is preferably heated to temperatures of 60 to 120° C. and, more particularly, to temperatures of 70 to 100° C., the solid constituents are dissolved or dispersed in the nonionic surfactant at those temperatures and the mixture formed is cooled to temperatures of 60° C. to room temperature, optionally after addition of the second nonionic surfactant.

In this process, the nonionic surfactant corresponding to formula (I) or (II) which is to be used in the smaller quantity is preferably introduced first because of the correspondingly lower energy demand for heating, heated, the foam regulator is optionally added, the carboxylic acid or its alkali metal salt is then introduced, the synthetic anionic surfactant is optionally added and, finally, the nonionic surfactant corresponding to formula (II) or (I) which was not added first is introduced.

The surfactant mixture according to the invention is substantially stable in storage and is flowable at temperatures in the range from room temperature to 40° C., even if the solids present in the mixture are not always fully dissolved in the nonionic surfactant at that temperature.

The surfactant mixture may be used for the production of liquid to paste-form detergents or cleaning formulations which are produced in basically known manner by incorporation of other ingredients typically encountered in such detergents or cleaning formulations. It is preferably used for the production of paste-form detergents or cleaning formulations consisting of a liquid phase and a fine-particle solid phase dispersed therein. The liquid phase of such detergents or cleaning formulations is essentially formed from the nonionic surfactants corresponding to formulae (I) and (II) present in the surfactant mixture according to the invention.

The use of the surfactant mixture according to the invention has the advantage that all substances which significantly influence the viscosity of the end product, more particularly the carboxylic acid or its salt, are incorporated in the detergent mixture. This considerably facilitates the uniform incorporation of those substances in detergents or cleaning formulations which contributes towards constant product quality, particularly in regard to viscosity. In addition, the compound according to the invention also affords advantages in the production of paste-form end products because incorporation of the carboxylic acid or its salts in powder form requires preliminary grinding. For reasons which have not been fully explained, this generally results in a loss of soap active substance which can be completely avoided where the surfactant mixture according to the invention is used. Moreover, it has been found that, where the surfactant mixture according to the invention is used for the production of paste-form detergents, their final viscosity is advantageously established more quickly than where the individual components of the surfactant mixture are separately used.

A paste-form detergent or cleaning formulation according to the invention is preferably so pseudoplastic that it has a viscosity in the range from 10,000 mPa·s to 500,000 mPa·s at 20° C. and at a shear rate of 0.025 $s^{-1}$, as measured with a Carrimed® CS 100 plate viscosimeter with a 2 cm cross-hatch flat plate (plate interval 1.5 mm). On exposure to adequate shear forces, a detergent according to the invention has a considerably lower, generally 2 to 15 times lower, viscosity which, for a shear rate of 0.2 $s^{-1}$ and otherwise the same measuring conditions, is in the range from 5,000 mPa·s to 130,000 mPa·s and, more particularly, in the range from 5,000 mPa·s to 13,000 mPa·s and, for a shear rate of 2 $s^{-1}$ and otherwise the same measuring conditions, in the range from 400 mPa·s to 100,000 mPa·s and, more particularly, in the range from 400 mPa·s to 1,600 mPa·s. To take any thixotropic effects of the paste into account, the cited values are again read off after a measuring time of 3 minutes. The reduction in viscosity is substantially reversible, i.e. on completion of shearing the detergent returns to its original physical state without any sign of separation. It is pointed out in this regard that the viscosities mentioned do not relate to measurements immediately after production of the paste, but instead to stored pastes in the equilibrium state so to speak because the shear forces applied during the production process lead to a lower paste viscosity which only increases gradually to the critical final viscosity. In general, storage times of 1 month are entirely sufficient for this purpose.

In one embodiment, a paste-form detergent according to the invention contains in particular 20% by weight to 80% by weight of the surfactant mixture according to the invention and 20% by weight to 80% by weight of additional solid powder-form fine-particle constituents. The constituents of the paste-form detergent which are present as the solid phase should be made up of fine particles and should have an average particle size of 5 μm to 120 μm, at most 10% of the particles being larger than 150 μm in size. Surprisingly, it is possible readily to incorporate relatively coarse-particle solids, for example those in which 20% to 50% of the particles are larger than 80 μm in size, in the paste-form detergents without any disadvantages. The average particle size of the particles forming the solid phase is preferably from 10 μm to 80 μm and more preferably from 10 μm to 60 μm, the maximum particle size being below 200 μm and, more particularly, below 150 μm. 90% by weight of the solid powder-form constituents are preferably smaller than 140 μm in size and, more preferably, smaller than 100 μm in size. The average particle size is based on the volume distribution of the particles which may be determined by known methods (for example by laser diffraction or by the Coulter Counter Method).

In efforts to optimize the pastes according to the invention, it was found that particularly stable paste-form detergents are obtained if the synthetic anionic surfactant in the surfactant compound according to the invention used for the production of the paste is used in its acid form, for example as free alkyl benzene sulfonic acid, and/or the carboxylic acid is used in the form of an alkali metal salt. Although the paste-form detergents formed had the same overall composition, they were surprisingly even more stable than detergents which had been produced using surfactant mixtures in which free carboxylic acid and synthetic anionic surfactant had been incorporated as an alkali metal salt.

The paste-form detergent and the surfactant mixture optionally used for its production are substantially free from water and organic solvents. By "substantially free from water" is meant a state in which the content of liquid water, i.e. water not present in the form of water of hydration and water of constitution, is below 5% by weight, preferably below 2% by weight and more preferably below 1% by weight. Higher water contents are a disadvantage because they disproportionally increase the viscosity of the detergent and, in particular, reduce its stability. Organic solvents, including the low molecular weight and low-boiling alcohols and ether alcohols typically used in liquid concentrates, and hydrotropic compounds are also absent apart from traces which can be introduced by individual active substances.

The detergent contains a solid phase which is homogeneously dispersed in the liquid surfactant phase and which contains the other cleaning-active detergent ingredients and optionally auxiliaries. The other cleaning-active ingredients include, above all, washing alkalis and compounds with a sequestering effect.

The liquid phase of the paste-form detergent according to the invention consists essentially of the nonionic surfactants corresponding to formulae (I) and (II), the surfactant mixture according to the invention and the synthetic anionic surfactant optionally present in that mixture which is largely distributed in the liquid phase. If the surfactant according to the invention is to be stored or transported at relatively low temperatures, it is best to use nonionic surfactants with a pour point (solidification point) below 5° C. in order to avoid solidification of the surfactant mixture. So far as the paste-form detergents according to the invention produced using the surfactant mixture according to the invention are concerned, this problem is not a factor because the detergents have such a high viscosity at temperatures as low as room temperature that any further solidification at lower temperatures is of no significance.

The preferred washing alkali present in the solid phase of the detergent according to the invention is amorphous and/or crystalline alkali metal silicate, more particularly sodium metasilicate with an $Na_2O$ to $SiO_2$ ratio of 1:0.8 to 1:1.3 and preferably 1:1, which is used in water-free form. Besides the metasilicate, water-free alkali metal carbonate is also suitable, but does require larger percentages of liquid phase on account of absorption processes and is therefore less preferred. The percentage silicate content of the detergent may be from 35% by weight to 70% by weight and is preferably from 40% by weight to 65% by weight and more preferably from 45% by weight to 55% by weight. Alkali metal carbonate is preferably present in quantities of at most up to 20% by weight and, more particularly, below 10% by weight.

Suitable sequestering agents are those from the class of aminopolycarboxylic acids and polyphosphonic acids. The aminopolycarboxylic acids include nitrilotriacetic acid, ethylenediamine tetraacetic acid, diethylenetriamine pentaacetic acid and higher homologs thereof. Suitable polyphosphonic acids are 1-hydroxyethane-1,1-diphosphonic acid, aminotri-(methylenephosphonic acid), ethylenediamine tetra-(methylenephosphonic acid) and higher homologs thereof, such as for example diethylene tetramine tetra-(methylenephosphonic acid). The acids mentioned above may normally be used in the form of their alkali metal salts, more particularly their sodium or potassium salts. Sodium nitrilotriacetate is preferably used in quantities of up to 10% by weight and preferably in quantities of 2% by weight to 6% by weight.

Other suitable sequestering agents are monomeric polycarboxylic acids or hydroxypolycarboxylic acids, more particularly in the form of alkali metal salts, for example sodium citrate and/or sodium gluconate.

Preferred sequestering agents include homopolymeric and/or copolymeric carboxylic acids and alkali metal salts thereof, the sodium or potassium salts being preferred. Particularly suitable among these sequestering agents are polymeric carboxylates or polymeric carboxylic acids with a relative molecular weight of at least 350 in the form of their water-soluble salts, more particularly their sodium and/or potassium salts, such as the oxidized polysaccharides according to International patent application WO 93/08251, polyacrylates, polyhydroxyacrylates, polymethacrylates, polymaleates and, in particular, copolymers of acrylic acid with maleic acid or maleic anhydride, preferably those of 50 to 70% of acrylic acid and 50 to 10% of maleic acid which are characterized, for example, in European patent EP 022 551. The relative molecular weight of the homopolymers is generally in the range from 1,000 to 100,000 while the relative molecular weight of the copolymers is in the range from 2,000 to 200,000 and preferably in the range from 50,000 to 120,000, based on free acid. A particularly preferred acrylic acid/maleic acid copolymer has a relative molecular weight of 50,000 to 100,000. Suitable although less preferred compounds of this class are copolymers of acrylic acid or methacrylic acid with vinyl ethers, such as vinyl methyl ethers, vinyl esters, ethylene, propylene and styrene, in which the percentage acid content is at least 50% by weight. Other suitable polymeric carboxylates or carboxylic acids are terpolymers which contain two carboxylic acids and/or salts thereof as monomers and vinyl alcohol and/or a vinyl alcohol derivative or a carbohydrate as the third monomer. The first acidic monomer or its salt is derived from a monoethylenically unsaturated $C_{3-8}$ carboxylic acid and preferably from a $C_{3-4}$ monocarboxylic acid, more particularly from (meth)acrylic acid. The second acidic monomer or its salt may be a derivative of a $C_{4-8}$ dicarboxylic acid, preferably a $C_{4-8}$ dicarboxylic acid, maleic acid being preferred. In this case, the third monomeric unit is formed by vinyl alcohol and/or preferably by an esterified vinyl alcohol. Vinyl alcohol derivatives in the form of an ester of short-chain carboxylic acids, for example $C_{1-4}$ carboxylic acids, with vinyl alcohol are particularly preferred. Preferred terpolymers contain 60 to 95% by weight and, more particularly, 70 to 90% by weight of (meth)acrylic acid or (meth)acrylate, preferably acrylic acid or acrylate, and maleic acid or maleate and 5 to 40% by weight and preferably 10 to 30% by weight of vinyl alcohol and/or vinyl acetate. Terpolymers in which the ratio by weight of (meth)acrylic acid or (meth)acrylate to maleic acid or maleate is from 1:1 to 4:1, preferably from 2:1 to 3:1 and more preferably from 2:1 to 2.5:1 are most particularly preferred. Both the quantities and the ratios by weight are based on the acids. The second acidic monomer or its salt may even be a derivative of an allyl sulfonic acid substituted in the 2-position by an alkyl radical, preferably a $C_{1-4}$ alkyl radical, or by an aromatic radical preferably derived from benzene or benzene derivatives. Preferred terpolymers contain 40 to 60% by weight and, more particularly, 45 to 55% by weight of (meth)acrylic acid or (meth)acrylate, preferably acrylic acid or acrylate, 10 to 30% by weight and preferably 15 to 25% by weight of methallyl sulfonic acid or methallyl sulfonate and, as the third monomer, 15 to 40% by weight and preferably 20 to 40% by weight of a carbohydrate. This carbohydrate may be, for example, a mono-, di-oligo- or polysaccharide, mono-, di- or oligosaccharides being preferred, sucrose being particularly preferred. Predetermined weak spots responsible for the degradability of the polymer are introduced by the use of the third monomer. The terpolymers used may be prepared by any of the known and routine methods. Terpolymers which are either completely or at least partly neutralized, more particularly more than 50% neutralized, based on the carboxyl groups present, are also preferably used. Particularly preferred terpolymers are produced by the process described in German patent applications DE 42 21 381 and DE 43 00 772.

The polyacetal carboxylic acids which are described, for example, in U.S. Pat. Nos. 4,144,226 and 4,146,495 and which are obtained by polymerization of esters of glycolic acid, introduction of stable terminal groups and saponification to the sodium or potassium salts are also suitable, as are polymeric acids obtained by polymerization of acrolein and disproportionation of the polymer with strong alkalis by the Canizzaro method. They are essentially made up of acrylic acid units and vinyl alcohol units or acrolein units.

The percentage content of organic carboxyfunctional builder materials in the paste-form detergent according to the invention may be up to 10% by weight and is preferably from 1% by weight to 7.5% by weight and more preferably from 2% by weight to 5% by weight while the percentage content of polyphosphonic acids is up to 3% by weight and preferably from 0.05% by weight to 1.5% by weight and more preferably from 0.1% by weight to 1% by weight. These builder materials are also used in water-free form.

Other sequestering agents suitable for the purposes of the invention are crystalline alkali metal silicates and fine-particle alkali metal alumosilicates, more particularly zeolites of the NaA type. Suitable zeolites have a calcium binding capacity of 100 to 200 mg CaO/g (as determined in accordance with DE 24 12 837 C2). Their particle size is typically in the range from 1 $\mu$m to 10 $\mu$m. They are used in dry form. The water present in bound form in the zeolites is not a problem in the present case. Preferred crystalline silicates, which may be present on their own or in admixture with the alumosilicates mentioned, are crystalline layer silicates corresponding to the formula $NaMSi_xO_{2x+1}.yH_2O$, in which M is sodium, x is a number of 1.9 to 4 and y is a number of 0 to 20, preferred values for x being 2, 3 or 4. Corresponding crystalline layer silicates are described, for example, in European patent application 164 514. Both β- and δ-sodium disilicates $Na_2Si_2O_5.yH_2O$ are particularly preferred, β-sodium disilicate being obtainable, for example, by the process described in International patent application WO 91/08171. Suitable crystalline silicates are commercially available under the names of SKS-6 (a product of Hoechst) and Nabion® 15 (a product of Rhone-Poulenc). The content of inorganic builder in the paste may be up to 35% by weight and is preferably up to 25% by weight and, more preferably, from 10% by weight to 25% by weight.

The detergent pastes according to the invention are preferably phosphate-free. If the presence of phosphate is ecologically acceptable (for example in the event of phosphate-eliminating wastewater treatment), polymeric alkali metal phosphates, such as sodium tripolyphosphate, may even be present. Their percentage content may be up to 20% by weight, based on the detergent as a whole, the percentage content of other solids, for example the alkali metal silicate and/or alumosilicate, being reduced accordingly. The percentage tripolyphosphate content is preferably at most 10% by weight.

Other constituents, which are also mainly to be assigned to the solid phase, are washing auxiliaries, including redeposition inhibitors, optical brighteners, bleaching agents and dyes. Where fragrances which are generally liquid are used, they pass over into the liquid phase. However, in view of the small quantities in which they are used, they have no significant effect on the flow behavior of the pastes.

Suitable redeposition inhibitors or soil release agents are cellulose ethers, such as carboxymethyl cellulose, methyl cellulose, hydroxyalkyl celluloses and cellulose mixed ethers, such as methyl hydroxyethyl cellulose, methyl hydroxypropyl cellulose and methyl carboxymethyl cellulose, and (poly)alkylene glycol esters of dicarboxylic acids, such as ethylene terephthalate/polyoxyethylene terephthalate copolyester. Sodium carboxymethyl cellulose and mixtures thereof with methyl cellulose are preferably used. The percentage content of redeposition inhibitor is generally up to 2% by weight and preferably from 0.5% by weight to 1.5% by weight.

Optical brighteners for textiles of cellulose fibers (cotton) are, in particular, derivatives of diaminostilbene disulfonic acid and alkali metal salts thereof. Suitable optical brighteners are, for example, salts of 4,4'-bis-(2-anilino-4-morpholino-1,3,5-triazin-6-yl-amino)-stilbene-2,2'-disulfonic acid or compounds of similar structure which contain a diethanolamino group, a methylamino group or a 2-methoxyethylamino group instead of the morpholino group. Brighteners of the substituted 4,4'-distyryl diphenyl type, for example 4,4'-bis-(4-chloro-3-sulfostyryl)-diphenyl, may also be present. Mixtures of brighteners may also be used. Brighteners of the 1,3-diaryl-2-pyrazoline type, for example 1-(p-sulfamoylphenyl)-3-(p-chlorophenyl)-2-pyrazoline, and compounds of similar structure are suitable for polyamide fibers. The content of optical brighteners or brightener mixtures in the detergent is generally up to 1% by weight and preferably from 0.05% by weight to 0.5% by weight.

Fine-particle bleaching agents may be present as another constituent of the solid phase. Suitable bleaching agents are peroxygen compounds, such as sodium perborate monohydrate and tetrahydrate, sodium percarbonate, persilicates, caroates and organic peracids, such as perbenzoates or peroxyphthalates. These peroxygen compounds are stable in storage in the detergents according to the invention through the substantial absence of water. The detergents may also contain known bleach activators which, on addition of water, hydrolyze with the peroxygen compounds to form peracids, for example N-acyl and O-acyl compounds, preferably N,N'-tetraacylated diamines, such as N,N,N',N'-tetraacetyl ethylenediamine, carboxylic anhydrides, such as benzoic anhydride and phthalic anhydride, and esters of polyols, such as glucose pentaacetate. Since the bleaching component is often separately added to the wash liquor in institutional laundries and, in general, is only used if there is special need, the presence of bleaching agents in the paste is not necessary in cases such as these.

Another advantage of the present invention is that there is no need whatever to add polyethylene glycols with low molecular weights, for example in the range from 200 to 800, which are normally intended to improve the flow properties of the pastes in quantities of up to 15%. These additives do not make any contribution towards washing power and are therefore not needed. For the same reason, the paste-form detergents according to the invention are preferably completely free from paraffin oils or liquid paraffin mixtures. However, small quantities of such substances, which normally reduce foaming to a certain extent under in-use conditions—a particular advantage in the final rinse cycle, may be present to support the foam regulator solid at room temperature. The percentage content of such liquid foam-reducing agents, which include liquid long-chain ethers in addition to the paraffin oils mentioned, in the paste-form detergents according to the invention is preferably no more than 5% by weight and, more particularly, is from 0.1% by weight to 2% by weight.

Production of the paste-form detergents according to the invention may be carried out immediately after production of the surfactant compound according to the invention, although the surfactant mixture according to the invention may also be readily stored for prolonged periods after its production. The paste-form detergents according to the invention are preferably produced by adding the other solid constituents, which may be present individually or in the form of mixtures containing two or more powder components, to the surfactant mixture according to the invention optionally reheated after storage and introduced into a standard stirred tank reactor at temperatures from room temperature to 120° C., care being taken to avoid any excessive introduction of air. It has been found in this regard that the process leads to particularly stable paste-form detergents when it is carried out at temperatures in the range from room temperature to 45° C., more particularly at temperatures of up to 40° C., or at temperatures in the range from 80° C. to 120° C. In addition, temperatures in the higher of these two temperature ranges facilitate wetting of the solid phase which leads to more rapid homogenization of the ingredients. The fine-particle solid components may be added in largely any order, although the alkali metal silicate—as the largest quantitative component of the solid phase—is preferably added last. The fine-particle main component may also be added at intervals, i.e. the alkali silicate may be added in portions in alternation with the solid secondary components. After the solids have been mixed with the surfactant compound, the paste formed is preferably ground to the particle size indicated for the solid phase in a mill, preferably a colloid mill, unless the fine-particle solids used already had the required particle sizes. This is preferably followed by homogenization of the ground solid constituents with the liquid phase in another stirred tank reactor, during which heat-sensitive minor components, for example bleaching agents, dyes and/or fragrances and also enzymes, more particularly protease, amylase, lipase and/or cellulase, and optionally enzyme stabilizers, more especially lower carboxylic acids or calcium compounds, may be incorporated in the paste. Homogenization may be followed by another grinding step if the particle size distribution indicated for the solid phase has still not been reached, particularly in cases where acicular or lamellar alkali metasilicate has been used.

In one preferred embodiment of the process according to the invention, 20 parts by weight to 45 parts by weight of a flowable surfactant compound according to the invention are mixed with 40 parts by weight to 65 parts by weight of solid powder-form alkali metal silicate and 2 parts by weight to 10 parts by weight of solid polymeric polycarboxylate and up to 5 parts by weight—particularly where it is missing from the surfactant compound—1 part by weight to 3.5 parts by weight of synthetic anionic surfactant, up to 10 parts by weight and, more particularly, 1.5 parts by weight to 8 parts by weight of a heavy-metal complexing agent, up to 5 parts by weight and, more particularly, 0.5 part by weight to 3 parts by weight of solid powder-form cellulose ether and up to 1 part by weight and, more particularly, 0.1 part by weight to 0.5 part by weight of powder-form optical brightener.

The pastes according to the invention are flowable and pumpable immediately after their production under the effect of the shear forces applied and may readily be packed in storage containers. Because the pastes according to the invention in the absence of shear forces soon become so viscous that they lose their flowability and can no longer be pumped, the storage containers are preferably transport containers, more especially containers with rigid outer walls, for example casks or drums, in which the product is delivered to the institutional washing machine and from which it can be dispensed into the washing machine or rather its stock liquor tank by means of a dispenser which is capable of developing adequate shear forces. A dispenser suitable for this purpose is described in German patent application P 43 32 850.4 entitled "A paste container and dispenser" in the name of Henkel Ecolab GmbH & Co. OHG.

EXAMPLES

Example 1

In a heatable stirred tank reactor, ethoxylated $C_{12/14}$ fatty alcohol (average degree of ethoxylation 3; manufacturer Henkel) and ethoxylated and then propoxylated $C_{12/14}$ fatty alcohol (average degree of ethoxylation 5, average degree of propoxylation 4; manufacturer Henkel) were heated to 80° C. in the quantity ratios shown in Table 1 below. Phosphoric acid monostearate/distearate (manufacturer: Hoechst) and then fatty acid sodium salt (Edenor® HT; manufacturer Henkel) and also sodium $C_{9/11}$ alkyl benzene sulfonate were then added with stirring, after which stirring was continued for a few minutes at 80° C. A surfactant mixture (G1) according to the invention was obtained. It was flowable and pumpable at room temperature and could be stored for several months without any change in its properties, especially its flowability.

TABLE 1

| Surfactant mixture G1 (parts by weight) | |
|---|---|
| Ethoxylated fatty alcohol | 20 |
| Ethoxylated/propoxylated fatty alcohol | 10 |
| Phosphoric acid mono/distearate | 1.5 |
| Fatty acid sodium salt | 1.5 |
| Alkyl benzene sulfonate | 2 |

Example 2

The quantities indicated in Table 2 of sodium nitrilotriacetate, polymeric polycarboxylate Na salt (Sokalan® CP 5; manufacturer BASF), sodium hydroxyethane-1,1-diphosphonate, cellulose ether (Relatin® DM 4050; manufacturer Aqualon), optical brightener (Tinopal® CBS; manufacturer Ciba-Geigy) and—last of all—sodium metasilicate were added as anhydrous powders at 55° C. to 35 parts by weight of surfactant mixture G1 from Example 1, the mixture being stirred for about 1 minute after the addition of each constituent, i.e. before the next constituent was added. The mixture was then ground in a mill (roller mill, continuous throughput), transferred to a stirred tank reactor and stirred for 10 minutes at its own temperature (around 40° C.) without external heating. A paste-form detergent W1 was obtained. It was flowable immediately after its production and was packed in 280 kg drums. After a storage time of 10 days, the detergent had a viscosity (as measured at 25° C. with a Brookfield® DV-II rotational viscosimeter, spindle No. 7, at 5 revolutions per minute) of 200,000 mPa·s and, under otherwise the same conditions at 50 revolutions per minute, 70,000 mPa·s. These viscosities of the paste did not change significantly after storage for 3 months. In addition, no phase separation or other phase separation was observed over that period, even when part of the paste accommodated in the drum was exposed to shear forces during transfer or rather dispensing into an institutional dishwashing machine.

TABLE 2

| Composition of paste W1 (parts by weight) | |
|---|---|
| G1 | 35 |
| Sodium nitrilotriacetate | 4 |
| Sokalan ® CP 5 | 5 |
| Hydroxyethane diphosphonate | 1 |
| Relatin ® DM 4050 | 1.5 |
| Tinopal ® CBS | 0.2 |
| Sodium metasilicate | 53.3 |

We claim:

1. A storable, flowable surfactant mixture which on addition of solid powder-form constituents form pseudoplastic paste-form detergent compositions, said flowable surfactant mixture containing alkoxylated alcohol and soap, comprising:

(a) 40% by weight to 70% by weight of a nonionic surfactant, liquid at room temperature, of the formula:

$$R^1—(OC_2H_4)_n—OH \quad (I)$$

wherein $R^1$ is an alkyl or alkenyl group containing 10 to 20 carbon atoms and an average degree of ethoxylation n of from 1 to 8;

(b) 20% by weight to 50% by weight of a nonionic surfactant, liquid at room temperature, of the formula:

$$R^2—(OC_2H_4)_r—(OC_3H_6)_p—OH \quad (II)$$

wherein $R^2$ is an alkyl or an alkenyl group containing 10 to 20 carbon atoms, an average degree of ethoxylation r of from 2 to 8 and an average degree of propoxylation p of from 1 to 6;

(c) 1% by weight to 10% by weight of at least one member selected from the group consisting of $C_{10}$ to $C_{22}$ carboxylic acids and alkali metal salts thereof, and (d) less than 5% by weight liquid water.

2. The surfactant mixture as claimed in claim 1, which additionally contains up to 10% by weight, of a synthetic anionic surfactant solid at room temperature.

3. The surfactant mixture as claimed in claim 1 which additionally contains up to 5% by weight of an alkali-stable and shear-stable foam regulator which is solid at room temperature.

4. The surfactant mixture as claimed in claim 1 which contains 48% by weight to 64% by weight of the nonionic surfactant of formula (I); 28% by weight to 40% by weight of the nonionic surfactant of formula (II); and 2% by weight to 6% by weight of the at least one member selected from the group consisting of carboxylic acids and alkali metal salts thereof.

5. The surfactant mixture as claimed in claim 1 which contains a carboxylic acid mixture, based on the carboxylic acid mixture as a whole, of 2% by weight to 8% by weight of a $C_{14}$, up to 1% by weight of a $C_{15}$, 18% by weight to 24% by weight of a $C_{16}$, up to 3% by weight of a $C_{17}$, 20% by weight to 42% by weight of a $C_{18}$ and 30% by weight to 44% by weight of a $C_{20}$ to $C_{22}$ carboxylic acid or alkali metal salts thereof.

6. The surfactant mixture as claimed in claim 1 wherein the nonionic surfactant of the formula (I) has an average degree of ethoxylation n of 1 to 6 and the nonionic surfactant of the formula (II) has an average degree of ethoxylation r of 3 to 7 and an average degree of propoxylation p of 3 to 5.

7. The process for the production of the surfactant mixture claimed in claim 1 which comprises: heating at least one of the nonionic surfactants of the formula (I) or (II) to a temperature of from 60° C. to 120° C., the solid constituents are dissolved or dispersed in the nonionic surfactant and the mixture formed is heated to a temperature of 60° C. to room temperature, after addition of the second nonionic surfactant if it was not present initially.

8. The process as claimed in claim 7, wherein the constituents, solid at room temperature, are mixed with the nonionic surfactant or the nonionic surfactants at temperatures from 70° C. to 100° C.

9. The process as claimed in claim 7 wherein the nonionic surfactant of the formula (I) or (II) which is to be used in the smaller quantity is heated, the optional foam regulator is added to the heated surfactant, the carboxylic acid or the alkali metal salt thereof is then introduced into the heated surfactant, the optional synthetic anionic surfactant is added to the heated surfactant and the nonionic surfactant of the formula (II) or (I) which was not added is introduced last.

10. A paste-form detergent which comprises: the surfactant mixture claimed in claim 1.

11. A pseudoplastic paste-form detergent composition containing solid fine-particles which has a sufficiently high viscosity, in the absence of shear forces, that it does not flow under the effect of gravity at room temperature, and has a lower viscosity and flows under the effect of gravity on exposure to shearing, which comprises (a) a surfactant mixture which contains 40% by weight to 70% by weight of a nonionic surfactant, liquid at room temperature, of the formula:

$$R^1—(OC_2H_4)_n—OH \quad (I)$$

wherein $R^1$ is an alkyl or alkenyl group containing 10 to 20 carbon atoms and an average degree of ethoxylation n of 1 to 8, 20% by weight to 50% by weight of a nonionic surfactant, liquid at room temperature, of the formula:

$$R^2—(OC_2H_4)_r—(OC_3H_6)_p—OH \quad (II)$$

wherein $R^2$ is an alkyl or alkenyl group containing 10 to 20 carbon atoms, an average degree of ethoxylation r of 2 to 8 and an average degree of propoxylation p of 1 to 6, and 1% by weight to 10% by weight of at least one member selected from the group consisting of $C_{10}$ to $C_{22}$ carboxylic acids and alkali metal salts thereof, and wherein 20% to 50% by weight of the solid particles have a particle size above 80 $\mu$m.

12. The detergent composition as claimed in claim 11, having a viscosity when determined using a Brookfield® DV-II or DV-II plus rotational viscosimeter with a No. 7 spindle, at 25° C. of more than 100,000 mPa·s at 5 revolutions per minute and a viscosity below 100,000 mPa·s at 50 revolutions per minute.

13. A paste-form, pseudoplastic detergent composition comprising (a) 20% by weight to 80% by weight of the surfactant mixture of claim 1 and (b) 20% by weight to 80% by weight of solid powder-form constituents with an average particle size of 5 $\mu$m to 120 $\mu$m, having a viscosity at 20° C. in the range from 10,000 mPa·s to 500,000 mPa·s at a shear rate of 0.025 $s^{-1}$, a viscosity in the range from 5,000 mPa·s to 130,000 mPa·s at a shear rate of 0.2 $s^{-1}$ and a viscosity in the range from 400 mPa·s to 10,000 mPa·s at a shear rate of 2 $s^{-1}$.

14. The paste-form detergent composition as claimed in claim 13, wherein 90% by weight of the solid powder-form constituents have a particle size below 140 $\mu$m.

15. The process for the production of the pseudoplastic paste-form detergent claimed in claim 11 which comprises introducing at least one solid detergent constituent into the surfactant mixture of claim 1 in a stirred mixing zone at a temperature from 80° C. to 120° C.

16. The process as claimed in claim 15, wherein the constituent which comprises the largest component by weight of the solid, is introduced last.

17. The process as claimed in claim 15 wherein the solid constituent which comprises the largest component by weight of the solid is introduced in portions.

18. The process as claimed in claim 15 which comprises after mixing of the at least one solid with the surfactant mixture, the paste formed is ground in a mill.

19. The process as claimed in claim 15 which comprises: mixing (a) 20 parts by weight to 45 parts by weight of a flowable surfactant mixture containing 40% by weight to 70% by weight of a nonionic surfactant, liquid at room temperature, of the formula:

$$R^1—(OC_2H_4)_n—OH \quad (I)$$

wherein $R^1$ is an alkyl or alkenyl group containing 10 to 20 carbon atoms and an average degree of ethoxylation n of 1 to 8, 20% by weight to 50% by weight of a nonionic surfactant, liquid at room temperature, of the formula:

$$R^2—(OC_2H_4)_r—(OC_3H_6)_p—OH \quad (II)$$

wherein $R^2$ is an alkyl or alkenyl group containing 10 to 20 carbon atoms, an average degree of ethoxylation r of 2 to 8 and an average degree of propoxylation p of 1 to 6, 1% by weight to 10% by weight of at least one member selected from the group consisting of $C_{10}$ to $C_{12}$ carboxylic acids and alkali metal salts thereof, up to 10% by weight of a synthetic anionic surfactant, solid at room temperature, up to 5% by weight of an alkali-stable and shear-stable foam regulator, solid at room temperature, and less than 5% by weight of liquid water, with (b) 40 parts by weight to 65 parts by weight of a solid powder-form alkali metal silicate, 2 parts by weight to 10 parts by weight of a solid polymeric polycarboxylate, up to 5 parts by weight of a synthetic anionic surfactant, up to 10 parts by weight of a heavy-metal complexing agent, up to 5 parts by weight of a solid powder-form cellulose ether and up to 1 part by weight of a powder-form optical brightener.

20. A process for charging a washing machine with liquid and solid detergent constituents, wherein a flowable surfactant mixture of claim 1, comprising 40% by weight to 70% by weight of a nonionic surfactant, liquid at room temperature, of the formula (I), 20% by weight to 50% by weight of a nonionic surfactant, liquid at room temperature, of the formula (II) and 1% by weight to 10% by weight of at least one member selected from the group consisting of $C_{10-22}$ carboxylic acids and alkali metal salts thereof is provided, a particulate solid wherein 20% to 50% by weight of the solid particles have a particle size above 80 $\mu$m is dispersed therein to form a non-flowable composition, the non-flowable composition is made flowable immediately before use by application of mechanical energy, in the form of stirring, the flowable preparation is diluted with a predetermined quantity of water and is introduced into the washing machine.

* * * * *